United States Patent [19]

Hardy

[11] Patent Number: 4,618,803

[45] Date of Patent: Oct. 21, 1986

[54] CURRENT LIMITED STROBE CHARGE CIRCUIT

[75] Inventor: Herbert L. Hardy, Sudbury, Mass.

[73] Assignee: Polaroid Corporation, Cambridge, Mass.

[21] Appl. No.: 673,101

[22] Filed: Nov. 19, 1984

[51] Int. Cl.[4] ..... H05B 41/32

[52] U.S. Cl. ..... 315/241 R; 315/245; 315/309; 315/311; 320/1; 361/275; 361/15

[58] Field of Search ..... 315/241 R, 241 S, 245, 315/200 A, 311, 309; 320/1; 361/15, 275

[56] References Cited

U.S. PATENT DOCUMENTS

| | | | |
|---|---|---|---|
| 2,983,850 | 5/1961 | Edgerton | 315/241 |
| 3,241,026 | 3/1966 | Andrich | 318/442 |
| 3,644,864 | 2/1972 | Hirsbrunner et al. | 338/25 |
| 3,774,073 | 11/1973 | Switsen | 315/227 |
| 3,845,349 | 10/1974 | Liebman | 315/200 A |
| 3,909,666 | 9/1975 | Tenen | 315/200 R |
| 4,074,170 | 2/1978 | Orban | 320/1 X |
| 4,329,726 | 5/1982 | Middleman et al. | 361/58 |

*Primary Examiner*—David K. Moore
*Assistant Examiner*—Vincent DeLuca
*Attorney, Agent, or Firm*—Edward S. Roman

[57] ABSTRACT

A current limited strobe charging circuit in which the charging current is automatically limited during the time required to reform the primary storage capacitor after a long period of non-use without materially effecting the current flow and time required to subsequently recharge the storage capacitor after it has been reformed includes a positive temperature coefficient resistor serially connected therewith to switch from a low resistance mode of operation to a high resistance mode of operation as a result of its own internally generated $I^2R$ heat.

7 Claims, 2 Drawing Figures

CURRENT LIMITED STROBE CHARGE CIRCUIT

BACKGROUND OF THE INVENTION

1. Field of the Invention

This invention relates generally to a current limited strobe charging circuit and, more particularly, to a strobe charging circuit in which the current is limited during the time required to reform the primary storage capacitor without materially affecting the current flow and time required to subsequently recharge the storage capacitor after it has been reformed.

2. Description of the Prior Art

Electronic flash or strobe devices comprising a flash discharge tube through which the charge from a primary storage capacitor may be discharged to provide an illuminating flash of light are conventional and well known to the art. Such storage capacitors may be charged by a variety of means in which the oscillating output of a power supply is generally stepped up to charge the capacitor at the requisite voltage required to provide the illuminating flash of light upon the discharge thereof through the flash discharge tube. Such storage capacitors if not frequently recharged develop high leakage currents after long periods of non-use and thus must be reformed so as to reduce the leakage current to a value at which energy can then be stored in the capacitor. The initial reforming of the capacitor can result in an excessive current drain as a result of the high leakage current thereby overloading and potentially damaging other components in the electronic flash charging circuit. In order to avoid such a dangerous overloading condition, some means of controlling the current must be provided which limits the current flow during the time required to reform the primary storage capacitor while not limiting the current flow during the time that the primary storage capacitor is recharged subsequent to its reforming. Thus, as is readily apparent, the current control must be variable so as to accommodate the variation in current drain presented by the primary storage capacitor during the time in which it is reformed and the succeeding time in which it is recharged.

Simple electronic flash charging circuits embodying voltage doubling circuits are well known in the art and provide a convenient, economical and simple circuit for charging a flash storage capacitor from an ordinary 115 volt AC line source. Such strobe charging circuits embodying voltage doublers, however, are particularly susceptible to the high current drains presented by leaky storage capacitors that must be reformed and inclusion of a complex current control circuit would substantially add to the complexity and cost of what is otherwise a simple and economical strobe charging circuit.

Therefore, it is a primary object of this invention to provide a simple and economical means for controlling the current flow in a flash charging circuit susceptible to high current drains encountered when storage capacitors must be initially reformed.

It is a further object of this invention to provide a simple and economic means for controlling the current flow to an electronic flash charging circuit of the type in which a voltage doubler circuit is utilized to limit the current flow during the time required to reform a storage capacitor without materially affecting the current flow and time required to subsequently charge the storage capacitor after it is reformed.

Other objects of the invention will in part be obvious and will in part appear hereinafter.

SUMMARY OF THE INVENTION

An electronic flash comprises a flash discharge tube, a storage capacitor and a trigger circuit responsive to an applied flash fire signal for effecting the discharge of the capacitor through the discharge tube to produce an illuminating flash of light. Means responsive to an applied source of electrical energy are provided for charging the storage capacitor. A positive temperature coefficient resistor element is serially connected between the source of electrical energy and the capacitor charging means to control the current flow from the source of electrical energy to the storage capacitor. The positive temperature coefficient resistor automatically switches to a high resistance mode to safely limit the flow of current during the reforming of the storage capacitor by the charging means and a low resistance mode so as not to materially affect the flow of current during the charging of the storage capacitor by the charging means subsequent to the storage capacitor being reformed.

DESCRIPTION OF THE DRAWINGS

The novel features that are considered characteristic of the invention are set forth with particularity in the appended claims. The invention itself, however, both as to its organization and its method of operation, together with other objects and advantages thereof will be best understood from the following description of the illustrated embodiment when read in connection with the accompanying drawings wherein:

DESCRIPTION OF THE PREFERRED EMBODIMENT

Figure 1:
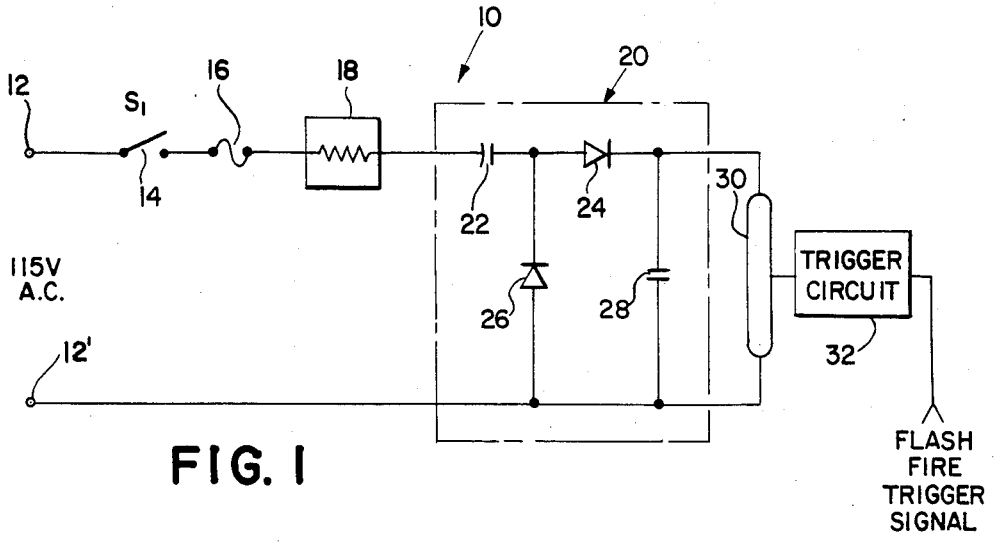
FIG. 1 is a schematic circuit diagram of an electronic flash device embodying the current control feature of this invention.

Referring now to FIG. 1, there is shown an electronic flash arrangement embodying the current control feature of this invention. The electronic flash 20 includes a pair of power input terminals 12, 12' for connection to a source of electrical energy which is preferably a standard 115 volt alternating current source. After connection to the source of electrical energy, the electronic flash 10 may be turned on and off by a power control switch $S_1$ as shown generally at 14. In serial connection with respect to the control switch 14, there is provided a fuse 16 which operates in an ordinary manner to protect the components of the strobe from being damaged by an excessive current draw. In serial connection with respect to the fuse 16, there is provided the current control feature of this invention which is preferably a positive temperature coefficient resistor 18 which may be purchased under the tradename Positor from Murata Corporation of America and which operates to control current in the manner of this invention to be subsequently described.

The electronic flash 10 further includes a flash discharge tube 30 of any well-known type through which the charge from a storage capacitor 28 is discharged upon the triggering of the flash tube in any well-known manner to produce an illuminating flash of light. The flash discharge tube 30 may be triggered to produce the flash of light in the ordinary manner by any conventional trigger circuit as shown at 32 which responds to a flash fire trigger signal provided most commonly at a select time during the exposure interval of a photographic camera. The storage capacitor 28 is connected in serial relation with respect to a first diode 24, and a second diode 26 is connected in parallel relation with respect to the diode 24 and storage capacitor 28. As is readily apparent, the anond-to-cathode polarity orientation of the diode 26 is arranged opposite to the anode-to-cathode polarity orientation of the diode 24. The common connection between the anode of the diode 24 and the cathode of the diode 26 also connects to the positive terminal of a second capacitor 22. The negative terminal of the capacitor 22 connects to the positive temperature coefficient resistor 18.

The capacitors 22 and 28 together with the diodes 24, 26 collectively operate in a well-known manner as a voltage doubler such that the voltage ultimately established across the storage capacitor 28 is equal to twice the peak line voltage of the 115 volt AC source of electrical energy. This line voltage doubling operation occurs as follows. During the first half cycle of the 115 volt AC source of electrical energy, the input voltage is positive thereby rendering diode 24 conductive and diode 26 non-conductive so as to charge storage capacitor 28 to the peak value of the input 115 volt AC source of electrical energy. As is well known, the peak value of the 115 volt AC source of energy is approximately 160 volts thereby causing the storage capacitor 28 to charge to 160 volts during the first half cycle of the 115 volt AC source. During the second half cycle of the 115 volt AC source, the input voltage is negative thereby rendering the diode 24 non-conductive while the diode 26 is rendered conductive to charge the capacitor 22 to the peak value of the negative half cycle of the 115 volt AC source. The peak value of the negative second half cycle of the 115 volt AC energy source is also in the order of 160 volts thereby resulting in the capacitor 22 being charged to 160 volts. The first half of the next succeeding cycle from the 115 volt AC energy source is again positive rendering the diode 24 conductive and the diode 26 non-conductive so as to establish a peak voltage of approximately 320 volts at the positive terminal of the capacitor 28. The peak 320 volts is established by the peak 160 volts of the positive half cycle of the 115 volt AC energy source in addition to the previously stored 160 volts across the capacitor 22 provided by the immediately preceding negative half cycle of the 115 volt AC source. In this manner the storage capacitor 28 is charged to a voltage level which is approximately twice the voltage level of the peak value of the 115 volt AC energy source.

Under conditions where the electronic flash 10 is not utilized for a long period of time, the storage capacitor 28 can generally be expected to develop a large leakage current and must be reformed by the charging current when the strobe is first turned on. Thus, when the strobe is first turned on after a long period of non-use, the capacitor 28 starts to reform and the leakage current gradually reduces to a specified value whereupon energy can then be stored in the capacitor 28. The positive temperature coefficient resistor 18 of this invention operates to limit the current flow during the time required to reform the capacitor 28 so as to avoid the high current drain precipitated by the high leakage current of the storage capacitor 28 that would otherwise blow the fuse 16 or damage the electrical components.

Figure 2:
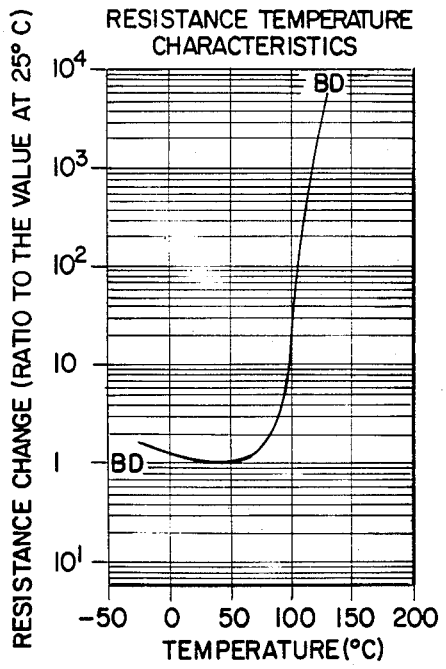
FIG. 2 is a graph showing the resistance versus temperature characteristic of the current control device of this invention.

Referring now to FIG. 2, there is shown a graph of the variation in resistance of the positive temperature coefficient resistor 18 with temperature. The increase of the current flow during the time required to reform the capacitor 28 operates to heat the positive temperature coefficient resistor 18 as a result of its own internally generated $I^2R$ heat so as to thereby effect a dramatic increase in the resistance thereof which limits the current flow to the storage capacitor 28 while it is being reformed. Once the storage capacitor 28 has been reformed and charged the leakage current reduces to a specified value, and the positive temperature coefficient resistor 18 will thereafter cool to a value at which the resistance is substantially reduced so as not to materially inhibit the current flow and time required to subsequently recharge the storage capacitor 28 after the flash tube 30 is fired.

The positive temperature coefficient resistor 18 of this invention is ideally suited for limiting the current flow during the time required to reform the storage capacitor 28 when the leakage current therethrough is large, as a result of the extremely large resistance change over a very small temperature span as shown in FIG. 2. Thus, there is provided a step like increase in resistance at what substantially approximates a switch temperature. For currents below this limiting current such as that required to effectively recharge the storage capacitor 28 after it has been reformed, and the flash tube 30 fired, the power generated in the positive temperature coefficient resistor 18 is insufficient to heat the resistor towards the aforementioned switch temperature. Thus, there is provided a simple, effective and economical means for controlling the line charging current in an electronic flash in situations where the storage capacitor has not been recently charged and thereby developed a high leakage current which is reduced by reforming of the capacitor. The line current is thereafter automatically restored to its initial value so as not to effect the time required to recharge the storage capacitor after it has been reformed and the electronic flash fired.

Other embodiments of the invention, including additions, subtractions, deletions and other modifications of the preferred disclosed embodiments of the invention will be obvious to those skilled in the art and are within the scope of the following claims.

What is claimed is:

1. An electronic flash comprising:

a flash discharge tube;

a storage capacitor;

trigger circuit means responsive to an applied flash fire trigger signal for effecting the discharge of said capacitor through said discharge tube to produce an illuminating flash of light;

means responsive to an applied source of electrical energy for charging said storage capacitor; and a positive temperature coefficient resistor element in serial connection between the source of electrical energy and said capacitor charging means to control the current flow from the source of electrical energy to said storage capacitor, said positive temperature coefficient resistor automatically switching to a high resistance mode to safely limit the flow of current during the reforming of said storage capacitor by said charging means and a low resistance mode so as not to materially affect the flow of current during the charging of said storage capacitor by said charging means subsequent to said storage capacitor being reformed.

2. The electronic flash of claim 1 wherein said positive temperature coefficient resistor element automatically switches from its said low resistance mode to its said high resistance mode as a result of its own internally generated $I^2R$ heat.

3. The electronic flash of claim 2 wherein the source of electrical energy is an alternating current source and said charging means operates to charge said storage capacitor to a voltage higher than the peak voltage of the alternating current source.

4. The electronic flash of claim 3 wherein said charging means comprises a first diode in series connection with respect to said storage capacitor, a second diode connected in parallel relation with respect to said first diode and said storage capacitor and in opposite polar orientation with respect to said first diode, and a second capacitor in series connection with respect to said first and second diodes, said positive temperature coefficient resistor also being connected in serial relation with respect to said second capacitor.

5. In an electronic flash of the type comprising a flash discharge tube, a storage capacitor, trigger circuit means responsive to an applied flash fire trigger signal for effecting the discharge of the storage capacitor through the discharge tube to produce an illuminating flash of light; and means responsive to an applied source of electrical energy for charging the storage capacitor, the improvement comprising a positive temperature coefficient resistor element connected in serial relation between the source of electrical energy and the charging means to control the current flow from the source of electrical energy to the storage capacitor, said positive temperature coefficient resistor automatically switching to a high resistance mode to safely limit the flow of current during the reforming of said storage capacitor by said charging means and a low resistance mode so as not to materially affect the flow of current during the charging of said storage capacitor by said charging means subsequent to said storage capacitor being reformed.

6. The improvement of claim 5 wherein said positive temperature coefficient resistor element automatically switches from its said low resistance mode to its said high resistance mode as a result of its own internally generated $I^2R$ heat.

7. The improvement of claim 6 wherein the source of electrical energy is an alternating current source; the charging means operates to charge the storage capacitor to a voltage higher than the peak voltage of the alternating current source and comprises a first diode in series connection with respect to the storage capacitor, a second diode connected in parallel relation with respect to the first diode and the storage capacitor and in opposite polar orientation with respect to the first diode, and a second capacitor in series connection with respect to said first and second diodes; and said positive temperature coefficient resistor is connected in serial relation with respect to the second capacitor.

* * * * *